US011873588B2

(12) United States Patent
Ray et al.

(10) Patent No.: US 11,873,588 B2
(45) **Date of Patent: *Jan. 16, 2024**

(54) WOVEN GEOTEXTILE FABRIC WITH INTEGRATED GEOTEXTILE GRIDS OR GEOGRIDS

(71) Applicant: Willacoochee Industrial Fabrics, Inc., Willacoochee, GA (US)

(72) Inventors: Kevin William Ray, Willacoochee, GA (US); Eric Lee Booth, Willacoochee, GA (US)

(73) Assignee: Willacoochee Industrial Fabrics, Inc., Willacoochee, GA (US)

( * ) Notice: Subject to any disclaimer, the term of this patent is extended or adjusted under 35 U.S.C. 154(b) by 10 days.

This patent is subject to a terminal disclaimer.

(21) Appl. No.: 17/861,608

(22) Filed: Jul. 11, 2022

(65) Prior Publication Data

US 2022/0341067 A1 Oct. 27, 2022

Related U.S. Application Data

(63) Continuation of application No. 16/557,391, filed on Aug. 30, 2019, now Pat. No. 11,384,458.

(Continued)

(51) Int. Cl.
*D03D 15/43* (2021.01)
*D03D 1/00* (2006.01)

(52) U.S. Cl.
CPC ..... *D03D 15/43* (2021.01); *D03D 1/00* (2013.01); *D10B 2505/20* (2013.01)

(58) Field of Classification Search
CPC ..... D03D 15/43; D03D 1/00; D03D 15/46; D03D 13/004; D03D 13/008; D10B 2505/20; D10B 2331/04; D10B 2505/204
See application file for complete search history.

(56) References Cited

U.S. PATENT DOCUMENTS 5,074,833 A * 12/1991 Futerman ..... B65D 88/1612 493/226
5,544,976 A * 8/1996 Marchbanks ..... B32B 27/12 405/129.6

(Continued)

FOREIGN PATENT DOCUMENTS

WO WO-20151003 A1 1/2015
WO WO-2015/100369 A1 7/2015

OTHER PUBLICATIONS

Drainage Geocomposites, https://www.geo-synthetics.com/construction-products/drainage-products/drainage-geocomposites-2/, accessed Aug. 26, 2019; 4 pages.

(Continued)

*Primary Examiner* — Robert H Muromoto, Jr.
(74) *Attorney, Agent, or Firm* — HARNESS, DICKEY & PIERCE, P.L.C.; Anthony G. Fussner

(57) ABSTRACT

A woven geotextile fabric utilizes a plurality of yarns including machine direction field yarns, cross machine direction field yarns, machine direction rib yarns, and cross machine direction rib yarns. The plurality of yarns is integrally woven together. The machine direction rib yarns and the cross machine direction rib yarns cooperatively define an integrated geotextile grid integrally within the woven geotextile fabric. The machine direction field yarns and the cross machine direction field yarns cooperatively define fabric areas in a field of the integrated geotextile grid generally between the machine direction rib yarns and the cross machine direction rib yarns.

37 Claims, 4 Drawing Sheets

Related U.S. Application Data

(60) Provisional application No. 62/730,348, filed on Sep. 12, 2018, provisional application No. 62/728,469, filed on Sep. 7, 2018.

(56) References Cited

U.S. PATENT DOCUMENTS 5,564,833 A * 10/1996 Proffitt ..... B65D 88/1618 383/22
5,795,835 A * 8/1998 Bruner ..... E02B 3/04 442/310
7,465,129 B2 * 12/2008 Singleton ..... E02D 17/20 256/12.5
7,565,779 B2 * 7/2009 Iske ..... E21D 11/381 52/742.13
RE42,695 E * 9/2011 Singleton ..... E02D 17/20 405/302.7
8,240,959 B1 * 8/2012 Rhoades ..... E02D 17/202 405/302.6
8,291,668 B2 * 10/2012 Iske ..... E21D 11/381 52/514.5
8,333,220 B2 * 12/2012 King ..... D03D 15/46 139/383 A
8,598,054 B2 * 12/2013 King ..... D03D 15/43 442/207
8,747,027 B1 * 6/2014 Singleton ..... E02D 17/202 405/302.7
9,011,005 B2 * 4/2015 Lin ..... E02B 3/127 383/117
10,024,022 B2 * 7/2018 Booth ..... D03D 13/008
10,434,445 B2 * 10/2019 Ray ..... D03D 15/567
11,384,458 B2 * 7/2022 Ray ..... D03D 15/43
2007/0199265 A1 * 8/2007 Iske ..... E21D 11/381 52/302.1
2009/0282762 A1 * 11/2009 Iske ..... E02D 31/02 52/302.1
2010/0029154 A1 2/2010 Tankere et al.
2013/0322789 A1 * 12/2013 Lin ..... B65D 33/00 383/117
2014/0154018 A1 * 6/2014 Singleton ..... E02D 3/005 405/302.7

OTHER PUBLICATIONS

Geocomposite—Wikipedia, https://en.wikipedia.org/wiki/Geocomposite, Dec. 28, 2017, 3 pages.
Combigrid® 40/40 Q1 151 GRK3, <http://terrafixgeo.com/wp-content/uploads/Terrafix-CombiGrid-4040_Q1-151-GRK-3_ASTM.pdf>, Feb. 11, 2009, 2 pages.
AGRU Geocomposite, Product Overview, htpps://arguamerica.com/products/geocomposite, accessed Sep. 6, 2018, 4 pages.
Geofabrics, <https://www.geofabrics.com/rk4/>, Copyright 2016, 2 pages.
Tensar® FilterGridTM (FG), <https://www.tensarcorp.com/Systems-and-Products/Tensar-FilterGrid> Copyright 2018, 9 pages.
Non-final Office Action for U.S. Appl. No. 16/712,135 which names the same inventors and assignee but is not related through a priority claim, dated Mar. 27, 2020, 14 pages.
Canadian Office action for Canadian application No. 3,054,537 that claims priority to the instant application; dated Nov. 4, 2021; 3 pages.

* cited by examiner

WOVEN GEOTEXTILE FABRIC WITH INTEGRATED GEOTEXTILE GRIDS OR GEOGRIDS

CROSS-REFERENCE TO RELATED APPLICATIONS

This application is a continuation of U.S. patent application Ser. No. 16/557,391 filed Aug. 30, 2019, which published as US2020/0080241 on Mar. 12, 2020 and issues as U.S. Pat. No. 11,384,458 on Jul. 12, 2022.

U.S. patent application Ser. No. 16/557,391 claims the benefit of and priority to U.S. Provisional Patent Application Ser. No. 62/728,469 filed Sep. 7, 2018 and U.S. Provisional Patent Application Ser. No. 62/730,348 filed Sep. 12, 2018.

The entire disclosures of the above patent applications are incorporated herein by reference.

FIELD

The present disclosure relates to woven geotextile fabrics with integrated geotextile grids or geogrids.

BACKGROUND

This section provides background information related to the present disclosure which is not necessarily prior art.

Geotextile grids or geogrids are commonly used for reinforcement and stress control in areas such as retaining walls or subbase soils. Geogrids are commonly made from synthetic materials that result in stiffness and strength much higher than soils alone.

Geogrids usually have ribs in both the machine direction and the transverse or cross machine direction. Between these ribs are a series of open areas or apertures. But there are other geogrids on the market that utilize a multidirectional or triaxial set of ribs.

Geogrids can be manufactured using several different technologies including a "punch and draw" method or an extrusion method. In the punch and draw method, a synthetic plastic sheet is punched and then drawn in both the machine direction and the transverse or cross machine direction. Or, in the case of the extrusion method, the geogrid may be extruded from a special die and then drawn in each direction.

Geogrids can be woven from strands of high tenacity yarns (e.g., polyester, polyethylene terephthalate (PET), etc.) and then coated with synthetic substances (e.g., polyvinyl chloride (PVC), etc.). And geogrids can be made using technology to bond the ribs together at certain intervals to achieve the desired results. All the geogrids mentioned above are characterized by having very high strengths with a predetermined number of ribs with crossing intersections and wide open apertures.

In contrast to geogrids, geotextile fabrics are permeable fabrics made using either woven or nonwoven technologies. Geotextile fabrics may serve the purposes of reinforcement, filtration, separation, confinement, and protection of soils. Characteristics of geotextile fabrics can generally be grouped by strength, hydraulic, and sediment retention properties. Geotextile fabrics are manufactured to allow water to pass through while soil and sediment are retained.

The engineering community specifies the use of both geogrids and geotextile fabrics in construction projects. As outlined above, geogrids and geotextile fabrics serve their own different respective purposes. And, in many cases, geogrids and geotextile fabrics are installed together. To better help eliminate installation cost and confusion, there are commercially available products that combine geogrids with geotextile fabrics. These combination geogrid/geotextile fabric products may be generally referred to as geocomposites.

DRAWINGS

The drawings described herein are for illustrative purposes only of selected embodiments and not all possible implementations, and are not intended to limit the scope of the present disclosure.

Corresponding reference numerals indicate corresponding (though not necessarily identical) parts throughout the several views of the drawings.

DETAILED DESCRIPTION

Example embodiments will now be described more fully with reference to the accompanying drawings.

As recognized by the inventors hereof, commercially available geocomposites are manufactured from two distinct products or components, i.e., a geotextile fabric and a geogrid. Conventional geocomposites may be made by first separately manufacturing the geotextile fabric and geogrid as distinct products in separate manufacturing steps or processes. Then, the distinct geotextile fabric and geogrid products may be attached (e.g., laminated, glued, heat bonded, mechanical fastened, etc.) to each other in an additional manufacturing step or process to thereby provide the geocomposite.

After recognizing the above, the inventors hereof have developed and disclosed herein exemplary embodiments of woven geotextile fabrics with integrated geotextile grids or geogrids. As disclosed herein, the yarns predetermined (e.g., produced, prepared, etc.) for the woven geotextile fabric and its integrated geotextile grid may be integrally woven together in a single step or operation on a weaving machine to thereby provide the woven geotextile fabric and its integrated geotextile grid. Unlike conventional methods and processes, exemplary embodiments disclosed herein do not require an additional conventional manufacturing step or operation of physically attaching (e.g., laminating, gluing, heating to bond the layers together, mechanical fastening, etc.) a separately manufactured geotextile fabric to a separately manufactured geogrid product.

Exemplary embodiments disclosed herein include woven geotextile fabrics with integrated geotextile grids that may perform as well as conventional geocomposites that are manufactured from two separate or distinct components, i.e., a geogrid and a separate geotextile fabric where the geogrid is physically attached separately to the geotextile fabric. The inventors hereof have determined that woven geotextile fabrics with integrated geotextile grids (e.g., woven geotextile fabric 100 shown in FIGS. 1, 2, and 3, etc.) made or manufactured by integrally weaving the yarns together (e.g., in a single step or operation on a weaving machine) can serve the same or similar purposes and achieve the same or similar results as a conventional two-component geocomposite.

For the purpose of description, the reinforced areas of the fabric are referred to herein as ribs. Also, for the purpose of description, the fabric areas between the ribs are referred to herein as the field of the fabric or simply the field.

Figure 1:
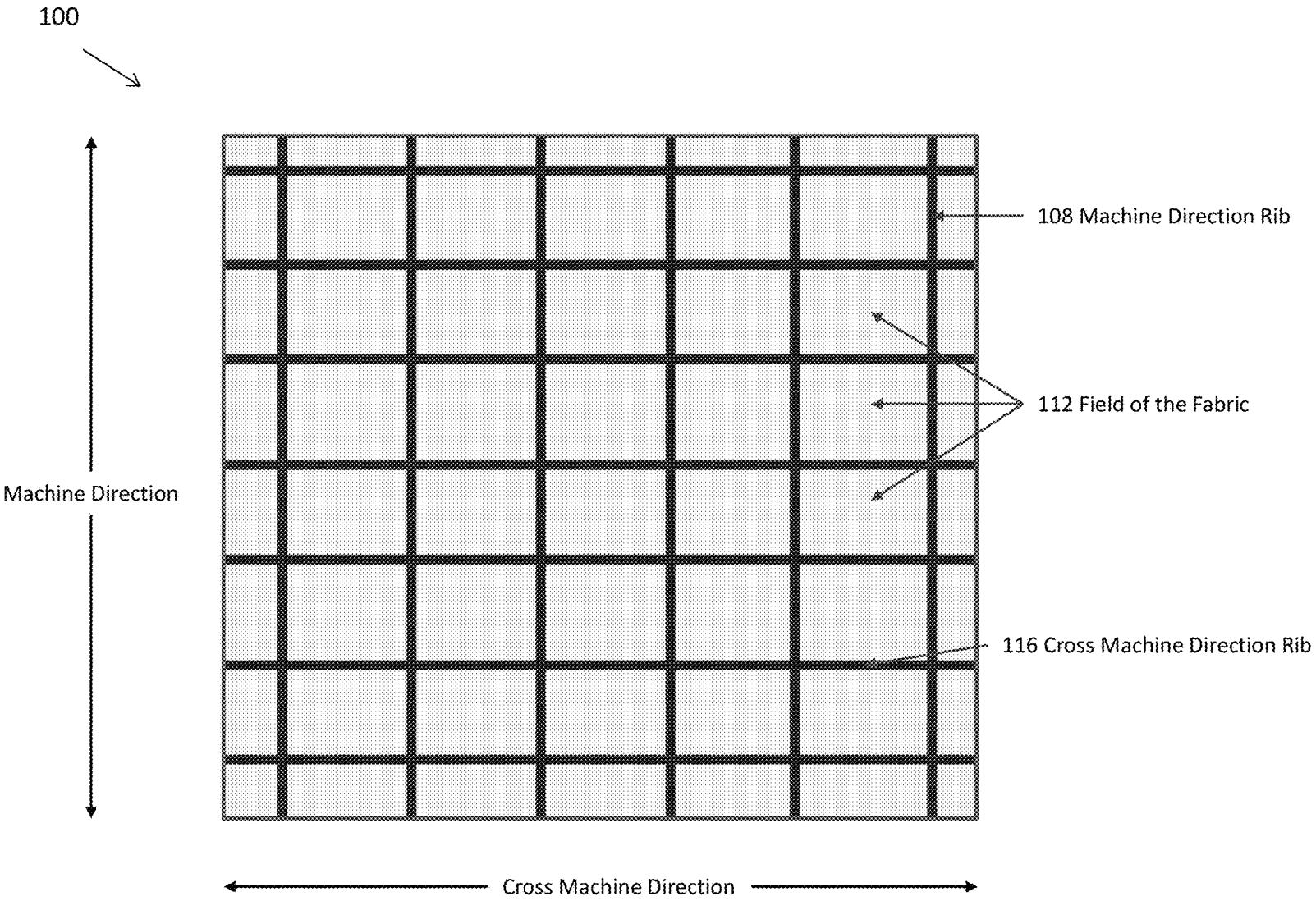
FIG. 1 illustrates a woven geotextile fabric with an integrated geotextile grid according to an exemplary embodiment in which the yarns are integrally woven together in a single step or operation on a weaving machine to thereby provide the woven geotextile fabric and its integrated geotextile grid.

The inventors hereof have determined that machine direction rib yarns (e.g., 128 in FIG. 3, etc.) may be inserted during the weaving process in a manner to create the machine direction ribs (e.g., 108 in FIG. 1, etc.). The ribs may be woven into the field of the fabric (e.g., 112 in FIG. 1, etc.) in a manner that allows the yarns to be a permanent and integral part of the overall fabric (e.g., 100 in FIGS. 1 and 2, etc.). The yarns for the machine direction ribs may be woven at intermittent junctions so as to allow the yarns for the ribs to be woven with very little crimp. This may advantageously allow the machine direction ribs to perform at the same or comparable strength as similar machine direction ribs in a geogrid.

Figure 2:
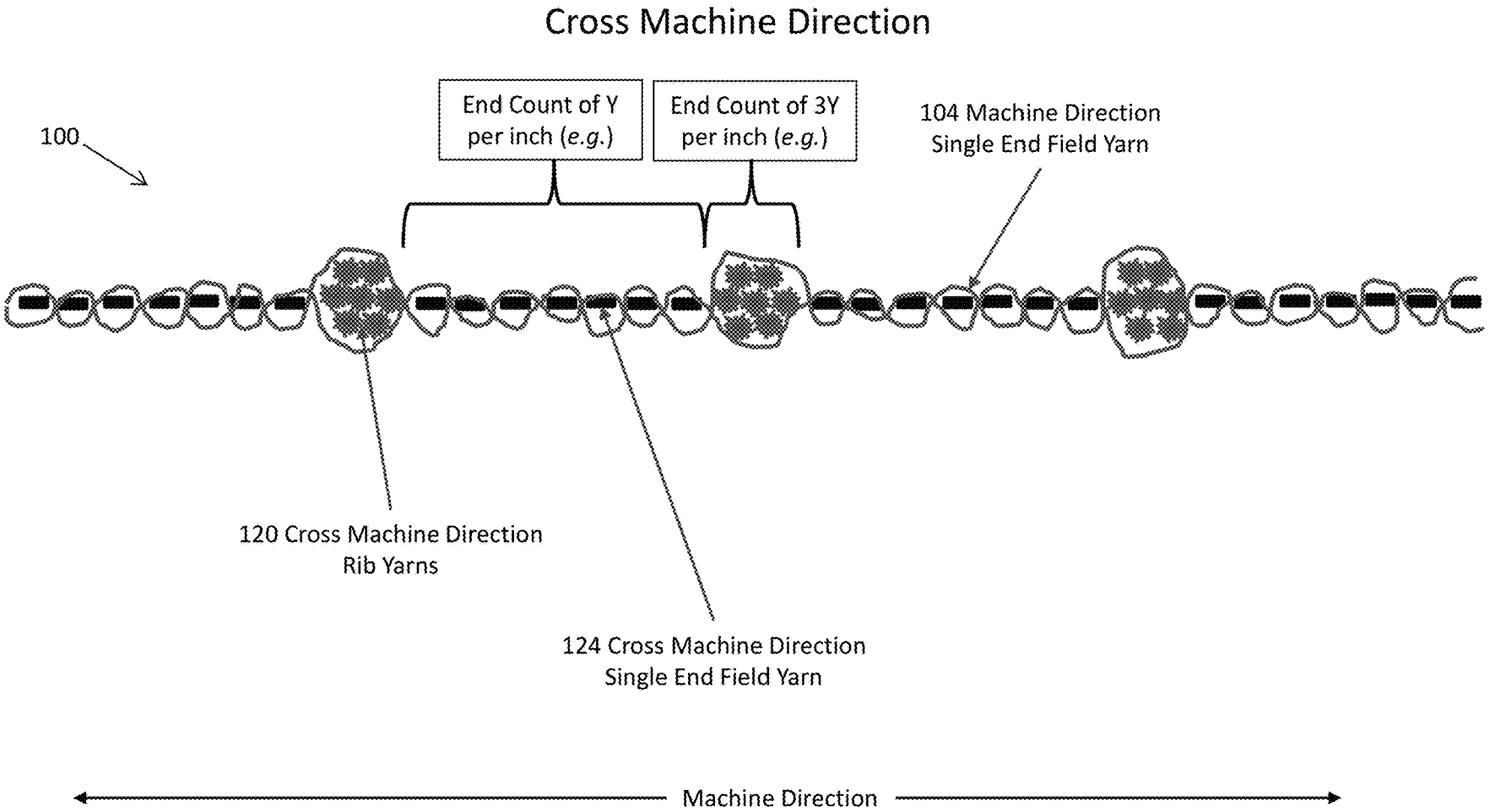
FIG. 2 is a side view of the woven geotextile fabric shown in FIG. 1, and illustrating cross machine direction rib yarns, cross machine direction single end field yarns, and machine direction single end field yarns according to an exemplary embodiment.

The cross machine direction ribs (e.g., 116 in FIG. 1, etc.) may be placed into the fabric by modifying the end count of the weaving machine during the insertion of the cross machine direction rib yarns (e.g., 120 and 124 in FIG. 2, etc.).

The yarns (e.g., 124 in FIG. 2, etc.) used for the cross machine direction ribs (e.g., 116 in FIG. 1, etc.) may generally be high tenacity PET (polyethylene terephthalate) filament yarns. The yarns (e.g., 128 in FIG. 3, etc.) used for the machine direction ribs (e.g., 108 in FIG. 1, etc.) may also generally be high tenacity PET (polyethylene terephthalate) filament yarns. Alternatively, the machine direction rib yarns and the cross machine direction rib yarns may be made from other substances and materials that provide high tenacity yarns, such as nylon, polypropylene, polyethylene, aramids, high molecular weight polyethylene (UHMWPE), fiberglass, basalt, etc. Examples of high tenacity yarns include yarns having a tenacity within a range from 6.5 grams per denier up to 40 grams per denier, yarns with a tenacity less than 6.5 grams per denier (e.g., 6 grams per denier, at least 4.5 grams per denier, etc.), yarns with a tenacity more than 40 grams per denier.

In addition, the machine direction rib yarns and the cross machine direction rib yarns do not have to be made from the same materials. For example, the machine direction rib yarns may be made from a first material different than a second material from which the cross machine direction rib yarns are made. Also, by way of example, each machine direction rib yarn does not necessarily have to be made of the same material as each other machine direction rib yarn in all embodiments. Likewise, each cross machine direction rib yarn does not necessarily have to be made of the same material as each other cross machine direction rib yarn in all embodiments.

The field of the fabric may be woven using slit tape yarns, fibrillated yarns, and/or monofilament yarns.

Yarn profiles may be oval, round, trilobal, multilobal, triangular, rectangular, non-circular, non-rectangular, and/or other cross-sectional shapes, geometries, profiles, etc. End counts of these yarns may vary to achieve a predetermined, satisfactory or proper water flow and sediment retention values as required for the particular end use. Also, each yarn does not necessarily have the same configuration (e.g., tensile strength, yarn type, etc.), same cross-sectional shape or profile, and/or same size (e.g., denier, diameter, thickness, etc.) as each other yarn in all embodiments.

Exemplary embodiments may provide a one piece fabric comprising at least two yarn types in the machine direction and at least two yarn types in the cross machine direction. For example, the fabric may include at least two yarns (one for the field and one for the rib) in the machine direction and at least two yarns (one for the field and one for the rib) in the cross machine direction.

The end count or density of the yarns in the field may be different than the end count or density of the yarns in the ribs. The end count of the rib yarns may be greater than the end count of the field yarns in exemplary embodiments. For example, the end count of the rib yarns may be at least one or more times (e.g., 1.1 times, 20 times, within a range from 1.1. to 20 times, more than 20 times, etc.) than the end count of the field yarns in exemplary embodiments. By way of further example, FIG. 2 illustrates the cross machine direction rib yarns 120 having an end count per inch that is three times the end count per inch of the cross machine direction single end field yarns 124. Also, for example, FIG. 3 illustrates the machine direction rib yarns 128 having an end count per inch that is three times the end count per inch of the machine direction single end field yarns 104.

Alternative embodiments may be configured differently, such as including cross machine direction rib yarns having an end count per inch that is less than or more than three times (e.g., less than 1.1 times, more than 20 times, greater than 1.1 but less than 3, within a range from 1.1 to 3, within a range from 3 to 20, etc.) the end count per inch of the cross machine direction single end field yarns and/or such as including machine direction rib yarns having an end count per inch that is less than or more than three times (e.g., less than 1.1 times, more than 20 times, greater than 1.1 but less than 3, within a range from 1.1 to 3, within a range from 3 to 20, etc.) the end count per inch of the machine direction single end field yarns. Also, the cross machine direction rib yarns and machine direction rib yarns do not have to have the same end counts (e.g., three times, etc.) as respectively compared to the cross machine direction single end field yarns and machine direction single end field yarns. For example, the end count of the cross machine direction rib yarns may be X times the end count of the cross machine direction single end field yarns, whereas the end count of the machine direction rib yarns may be Y times the end count of the machine direction single end field yarns where Y is greater than or less than X.

As disclosed for exemplary embodiments herein, the inventors hereof have determined a manner to change density of the cross machine direction yarns (e.g., at will, etc.) during the weaving process while introducing a plurality (e.g., at least 2, up to 8, between 2 to 8, more than 8, etc.) of different cross machine direction yarns as needed. As a result, exemplary embodiments disclosed herein may advantageously provide fabrics that resemble and/or have similar performance as conventional geocomposites while not requiring a secondary attachment step or operation after fabric formation during the weaving process.

Figure 3:
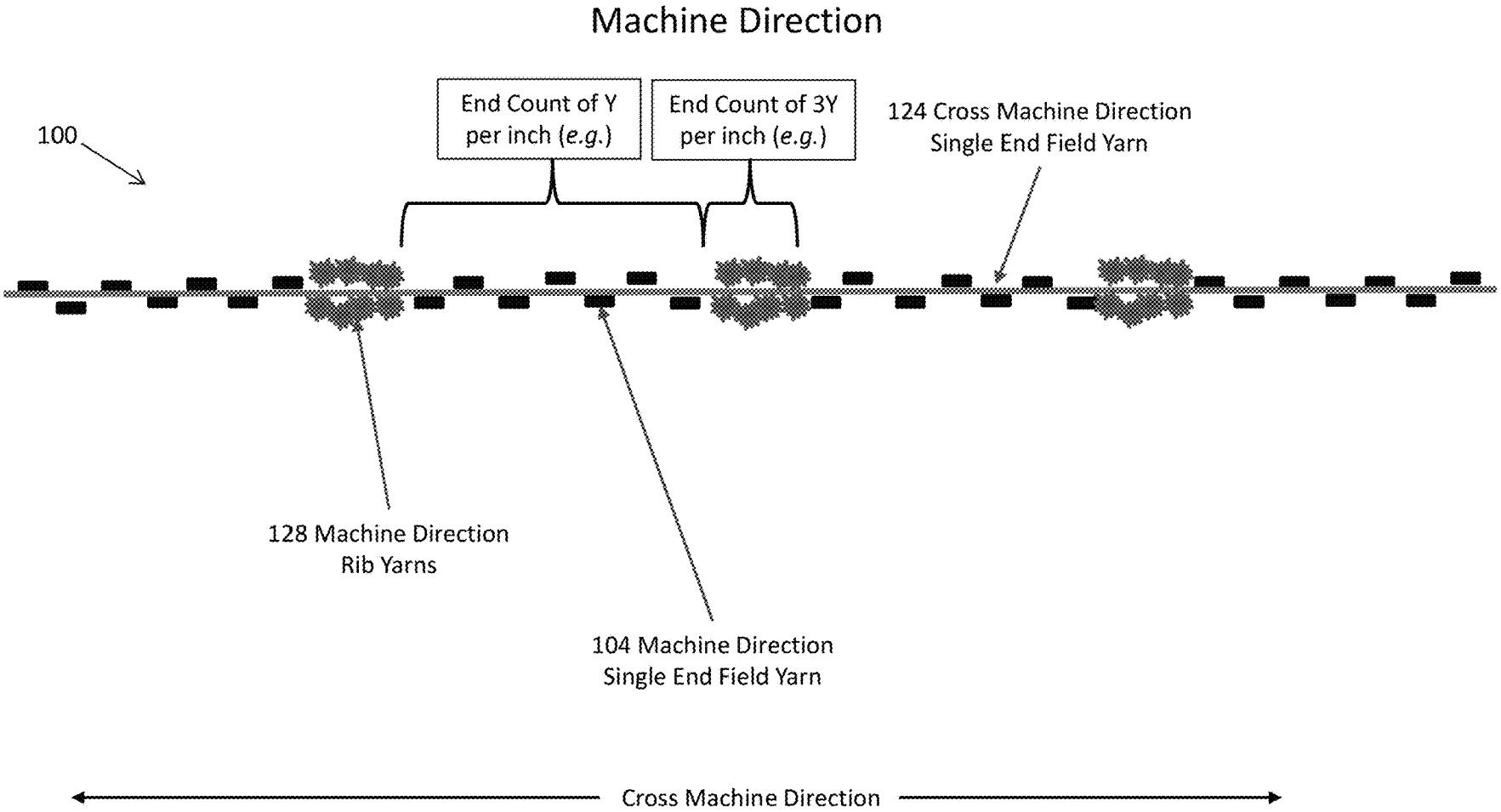
FIG. 3 is a side view of the woven geotextile fabric shown in FIG. 1, and illustrating machine direction rib yarns, machine direction single end field yarns, and cross machine direction single end field yarns according to an exemplary embodiment.

With reference to the figures, FIGS. 1, 2, and 3 illustrate an exemplary embodiment of a woven geotextile fabric with an integrated geotextile grid or geogrid 100 embodying one or more aspects of the present disclosure. The woven geotextile fabric 100 includes machine direction rib yarns 128 (FIG. 3) that are inserted during the weaving process in a manner to create the machine direction ribs 108 (FIG. 1).

The machine direction ribs 108 may be woven into the field 112 of the fabric 100 in a manner that allows the machine direction rib yarns 128 to be a permanent and integral part of the overall fabric 100. The yarns 128 for the machine direction ribs 108 may be woven at intermittent junctions so as to allow the yarns 128 for the machine direction ribs 108 to be woven with very little crimp. This advantageously may allow the machine direction ribs 108 to perform at a same or comparable strength as similar ribs in a geogrid.

The cross machine direction ribs 116 may be placed into the fabric 100 by modifying the end count of the weaving machine during the insertion of the cross machine direction rib yarns 120. For example, FIG. 2 illustrates the cross machine direction rib yarns 120 having an end count per inch that is three times (e.g., end count of 3Y per inch, etc.) the end count per inch of the cross machine direction single end field yarns 124. Alternatively, the end count of the cross machine direction rib yarns 120 may be higher or lower than three times (e.g., less than 1.1 times, more than 20 times, greater than 1.1 but less than 3, within a range from 1.1 to 3, within a range from 3 to 20, etc.) the end count of the cross machine single end field yarns 124 in other exemplary embodiments.

FIG. 3 illustrates the machine direction rib yarns 128 having an end count per inch that is three times (e.g., end count of 3Y per inch, etc.) the end count per inch of the machine direction single end field yarns 104. Alternatively, the end count of the machine direction rib yarns 128 may be higher or lower than three times (e.g., less than 1.1 times, more than 20 times, greater than 1.1 but less than 3, within a range from 1.1 to 3, within a range from 3 to 20, etc.) the end count of the machine direction single end field yarns 104 in other exemplary embodiments.

The cross machine direction rib yarns 120 used for the cross machine direction ribs 116 may generally be high tenacity PET (polyethylene terephthalate) filament yarns. The machine direction rib yarns 128 (FIG. 3) used for the machine direction ribs 108 may also generally be high tenacity PET (polyethylene terephthalate) filament yarns. But in other exemplary embodiments, the machine direction rib yarns 128 and/or the cross machine direction rib yarns 120 may be made from other substances and materials that provide high tenacity yarns, such as nylon, polypropylene, polyethylene, aramids, high molecular weight polyethylene (UHMWPE), fiberglass, basalt, etc. Examples of high tenacity yarns may include yarns having a tenacity within a range from 6.5 grams per denier up to 40 grams per denier, yarns with a tenacity less than 6.5 grams per denier (e.g., 6 grams per denier, at least 4.5 grams per denier, etc.), yarns with a tenacity more than 40 grams per denier.

The field 112 of the fabric 100 may be woven using slit tape yarns, fibrillated yarns, and/or monofilament yarns.

Profiles for the machine direction field yarns 104, cross machine direction field yarns 124, cross machine direction rib yarns 120, and machine direction rib yarns 128 may be oval, round, trilobal, multilobal, triangular, rectangular, non-circular, among other cross-sectional shapes, geometries, profiles, etc. In addition, the machine direction field yarns 104, cross machine direction field yarns 124, cross machine direction rib yarns 120, and machine direction rib yarns 128 may have the same, similar, or different profiles.

For example, FIGS. 2 and 3 illustrate the rectangular profiles of the cross machine direction field yarns 124 and the machine direction field yarns 104, respectively. FIGS. 2 and 3 also illustrate the multilobal profiles of the cross machine direction rib yarns 120 and machine direction rib yarns 128, respectively. Alternatively, each cross machine direction field yarn 124 and each machine direction field yarn 104 does not necessarily have the same profile and/or the same size (e.g., denier, diameter, thickness, etc.) as each other cross machine direction field yarn 124 and each machine direction field yarn 104. Likewise, each cross machine direction rib yarn 120 and each machine direction rib yarn 128 does not necessarily have the same profile and/or the same size (e.g., denier, diameter, thickness, etc.) as each other cross machine direction rib yarn 120 and each machine direction rib yarn 128.

End counts of the machine direction field yarns 104, cross machine direction field yarns 124, cross machine direction rib yarns 120, and machine direction rib yarns 128 may vary to achieve a predetermined, satisfactory, and/or proper water flow and sediment retention values as required for the particular end use.

By way of example, one exemplary embodiment of the woven geotextile fabric 100 included machine direction rib yarns 128 and cross machine direction rib yarns 120 comprising polyethylene terephthalate filament yarns having a denier of about 18,000, a generally round cross-sectional shape, a tenacity within a range from at least about 6.5 grams per denier up to at least about 40 grams per denier. The machine direction rib yarns 128 had an end count of 24 per inch, whereas the cross machine direction rib yarns 120 had an end count of 18 per inch. Continuing with this example, the machine direction field yarns 104 comprised polypropylene slit tape yarns having a denier of about 800, a generally rectangular cross-sectional shape, a tenacity less than the machine direction rib yarns 128, and an end count of 16 per inch. Also in this example, the cross machine direction field yarns 124 comprised polypropylene slit tape yarns having a denier of about 2100, a generally rectangular cross-sectional shape, a tenacity less than the cross machine direction rib yarns 120, and an end count of 10 per inch.

For illustrative purposes, a sample geotextile fabric was produced that achieves 200 pounds of tensile strength (ASTM D4632) in both the machine direction and the cross machine direction. This sample geotextile fabric included machine direction polypropylene slit tape yarns having a denier of about 800, a generally rectangular cross-sectional shape, and an end count of 16 per inch. This sample geotextile fabric also included cross machine direction polypropylene slit tape yarns having a denier of about 210, a generally rectangular cross-sectional shape, and an end count of 10 per inch. This sample geotextile fabric was tested with results for strength listed in Table 1 below.

The same geotextile fabric was then manufactured with introduction of high tenacity PET filament yarns having a denier of about 18,000, a generally round cross-sectional shape, and tenacity within a range from at least about 6.5 grams per denier up to at least about 40 grams per denier in both the machine and cross machine directions. These high tenacity PET yarns were inserted during weaving in a manner that created an integrated geotextile grid or ribbed geogrid within the 200 pound geotextile fabric. For example, two machine direction rib yarns comprising PET filament yarns having 18,000 denier each were inserted every inch in the machine direction at 1.5 times the density of the ends of the field yarns forming the geotextile fabric. At the same time, two cross machine direction rib yarns comprising PET filament yarns having 18,000 denier were inserted every inch in the cross machine direction at 2 times the density of the field yarns forming the geotextile fabric. The machine direction rib yarns 128 had an end count of 24 per inch, whereas the cross machine direction rib yarns 120 had an end count of 18 per inch.

The result was a 200 pound geotextile fabric with an integrated geogrid, which was manufactured in a single step or process during the weaving process. Results for the same tests can be viewed in Table 2.

TABLE 1

Test Results Typical Woven 200 pound Geotextile Fabric

| Property | Test Method | Machine Direction Value | Cross Machine Direction Value |
|---|---|---|---|
| Tensile Strength (Grab) | ASTM D4632 | 220 lbs | 250 lbs |
| Wide Width Tensile | ASTM D4595 | 1560 lbs/ft | 2200 lbs/ft |
| Wide Width @ 2% Strain | ASTM D4595 | 355 lbs/ft | 860 lbs/ft |
| Wide Width @ 5% Strain | ASTM D4595 | 710 lbs/ft | 1675 lbs/ft |

TABLE 2

Test Results Woven 200 pound Geotextile Fabric with Integrated Geogrid

| Property | Test Method | Machine Direction Value | Cross Machine Direction Value |
|---|---|---|---|
| Tensile Strength (Grab) | ASTM D4632 | 715 lbs | 620 lbs |
| Wide Width Tensile | ASTM D4595 | 7440 lbs/ft | 6885 lbs/ft |
| Wide Width @ 2% Strain | ASTM D4595 | 1245 lbs/ft | 2080 lbs/ft |
| Wide Width @ 5% Strain | ASTM D4595 | 2540 lbs/ft | 3940 lbs/ft |

As shown by a comparison of Tables 1 and 2, the woven 200 pound geotextile fabric with the integrated geogrid has considerably higher machine direction and cross direction values for tensile strength (grab), wide width tensile, wide width at 2% strain, and wide width at 5% strain as compared to the conventional 200 pound geotextile fabric. Accordingly, the integrated geogrid significantly increased the tensile strength of the woven 200 pound geotextile fabric.

The machine direction rib yarns and the cross machine direction rib yarns are preferably thicker than the machine direction field yarns and the cross machine direction field yarns. With the greater thickness of the rib yarns, the integrated geotextile grid cooperatively defined by the machine direction rib yarns and the cross machine direction rib yarns is therefore thicker than the fabric areas cooperative defined by the machine direction field yarns and the cross machine direction field yarns. Advantageously, the thicker integrated geotextile grid may thus have a higher pullout resistance (e.g., vertically and/or horizontally, etc.) in soil than the thinner fabric areas cooperative defined by the machine direction field yarns and the cross machine direction field yarns.

By way of example, an exemplary embodiment of a woven geotextile fabric having an integrated geotextile grid may be placed generally horizontally across a layer of soil and/or aggregate and within a vertical retaining wall. Soil and/or aggregate may become entangled or enmeshed within the relatively thick integrated geotextile grid, which may provide significant resistance to prevent or inhibit the retaining wall from toppling over. In which case, the integrated geotextile grid may help hold the retaining wall upright, and the soil and/or aggregate that is retained within the integrated geotextile grid inhibits or prevents the integrated geotextile grid from being easily pulled out.

Figure 4:
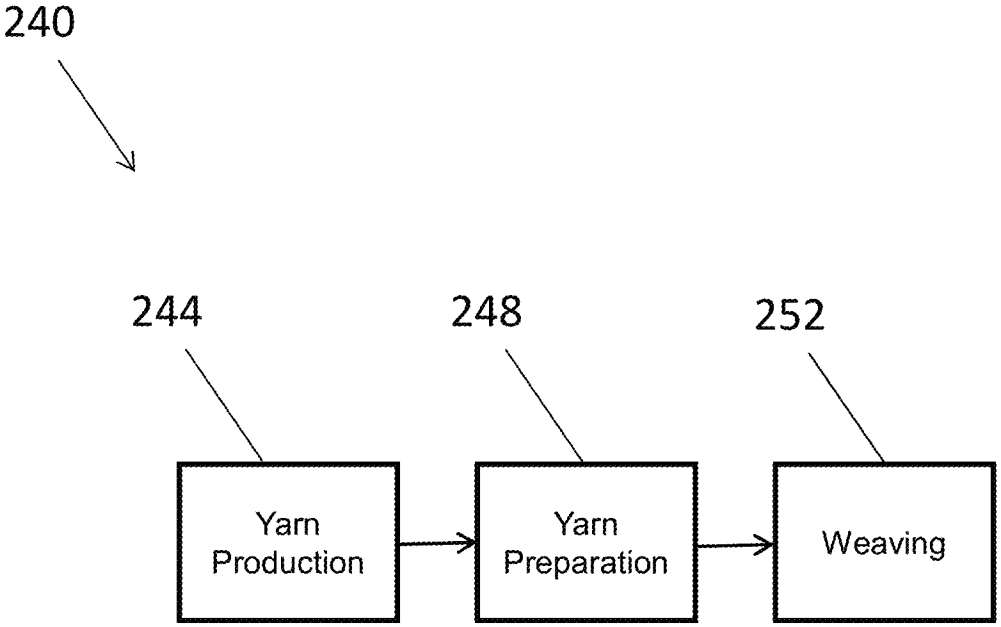
FIG. 4 is a process flow chart representing an exemplary manufacturing process or method according to exemplary embodiments in which yarns are integrally woven together in a single step or operation on a weaving machine to thereby provide a woven geotextile fabric having an integrated geotextile grid.

FIG. 4 is a process flow chart representing an exemplary manufacturing process or method 240 of making a woven geotextile fabric (e.g., fabric 100 in FIGS. 1, 2, and 3, etc.) with an integrated geotextile grid according to exemplary embodiments. The woven geotextile fabric and its integrated geotextile grid may be made by a weaving machine in a single step or operation 252 without requiring the additional conventional steps or operations of manufacturing the woven geotextile fabric separately from the integrated geotextile grid and thereafter physically attaching (e.g., laminating, gluing, heat bonding, etc.) the previously manufactured geotextile fabric separately to the previously manufactured geogrid product as conventionally done. As disclosed herein, the yarns for the woven geotextile fabric and its integrated geotextile grid are integrally woven together (e.g., in a single weaving step or operation on a weaving machine, etc.), such that neither the geotextile fabric nor its integrated geotextile grid are manufactured separately from each other at different times and/or via different process as distinct products that must thereafter be subsequently joined together. As also disclosed herein, the woven geotextile fabric and its integrated geotextile grid are configured such that the yarn type and yarn density changes in both the machine direction and the cross machine direction in exemplary embodiments.

Generally, the method 240 includes three operations or steps labeled as yarn production 244, yarn preparation 248, and weaving 252 as shown in FIG. 4. At the yarn production step or operation 244, yarn is produced or manufactured. By way of example only, the yarn preparation step or operation 248 may include beaming. Or, for example, the yarn preparation step or operation 248 may include presenting yarn to a weaving machine, commonly called a loom, directly from a creel, such that beaming is bypassed and there is no beaming required. Accordingly, aspects of the present disclosure are not limited to any particular way of how yarn gets into the loom or weaving machine.

At the third step or operation 252, the weaving machine or loom is used for weaving. Aspects of the present disclosure are not limited to and are not dependent on any particular type of weave.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A woven geotextile fabric comprising a plurality of yarns including machine direction field yarns, cross machine direction field yarns, machine direction rib yarns, and cross machine direction rib yarns, wherein the plurality of yarns is integrally woven together such that:

the machine direction rib yarns and the cross machine direction rib yarns cooperatively define an integrated geotextile grid integrally woven within the woven geotextile fabric without having to manufacture the integrated geotextile grid separately from the woven geotextile fabric and/or without having to physically attach the integrated geotextile grid separately to the woven geotextile fabric; and the machine direction field yarns and the cross machine direction field yarns cooperatively define fabric areas in a field of the integrated geotextile grid generally between the machine direction rib yarns and the cross machine direction rib yarns.

2. The woven geotextile fabric of claim 1, wherein the plurality of yarns is integrally woven together such that the machine direction rib yarns and the cross machine direction rib yarns cooperatively define the integrated geotextile grid integrally woven within the woven geotextile fabric without a separate physical non-woven attachment between the integrated geotextile grid and the woven geotextile fabric.

3. The woven geotextile fabric of claim 1, wherein the plurality of yarns is integrally woven together such that the machine direction rib yarns and the cross machine direction rib yarns cooperatively define the integrated geotextile grid integrally woven within the woven geotextile fabric without a lamination, glue, or heat bond between the integrated geotextile grid and the woven geotextile fabric.

4. The woven geotextile fabric of claim 1, wherein the plurality of yarns is integrally woven together such that the machine direction rib yarns and the cross machine direction rib yarns cooperatively define the integrated geotextile grid integrally woven within the woven geotextile fabric without laminating, gluing, heat bonding, or mechanical fastening the integrated geotextile grid and the woven geotextile fabric.

5. The woven geotextile fabric of claim 1, wherein:

yarn type and yarn density of the machine direction field yarns are different than the yarn type and yarn density of the machine direction rib yarns such that the yarn type and yarn density of the woven geotextile fabric change along the machine direction; and yarn type and yarn density of the cross machine direction field yarns are different than the yarn type and yarn density of the cross machine direction rib yarns such that the yarn type and yarn density of the woven geotextile fabric change along the cross machine direction.

6. The woven geotextile fabric of claim 1, wherein:

the machine direction rib yarns and the cross machine direction rib have higher tensile strength than the machine direction field yarns and the cross machine direction field yarns; and the integrated geotextile grid cooperatively defined by the machine direction rib yarns and the cross machine direction rib yarns has a higher tensile strength than the fabric areas cooperatively defined by the machine direction field yarns and the cross machine direction field yarns.

7. The woven geotextile fabric of claim 1, wherein the machine direction rib yarns and the cross machine direction rib yarns are thicker than the machine direction field yarns and the cross machine direction field yarns, such that the integrated geotextile grid cooperatively defined by the machine direction rib yarns and the cross machine direction rib yarns is thicker than and has a higher pullout resistance in soil than the fabric areas cooperatively defined by the machine direction field yarns and the cross machine direction field yarns.

8. The woven geotextile fabric of claim 1, wherein the plurality of yarns is integrally woven together such that:

the machine direction rib yarns define machine direction ribs;

the cross machine direction rib yarns define cross machine direction ribs;

the machine direction field yarns and the cross machine direction field yarns cooperatively define the fabric areas generally between the machine direction ribs and the cross machine direction ribs;

the machine direction ribs and the cross machine direction ribs cooperatively define the integrated geotextile grid as an integral part of the woven geotextile fabric; and the machine direction ribs and the cross machine direction ribs are thicker and have higher tensile strength than the machine direction field yarns and the cross machine direction field yarns.

9. The woven geotextile fabric of claim 1, wherein the machine direction rib yarns are woven at intermittent junctions with very little crimp relative to one or more of the other yarns of the plurality of yarns.

10. The woven geotextile fabric of claim 1, wherein:

the machine direction rib yarns and the cross machine direction rib yarns comprise yarns having a tenacity of at least about 4.5 grams per denier; and/or the machine direction rib yarns and the cross machine direction rib yarns comprise polyethylene terephthalate filament yarns.

11. The woven geotextile fabric of claim 1, wherein:

an end count density of the machine direction field yarns is less than an end count density of the machine direction rib yarns;

an end count density of the cross machine direction field yarns is less than an end count density of the cross machine direction rib yarns;

the machine direction field yarns have a cross-sectional shape different than a cross-sectional shape of the machine direction rib yarns; and the cross machine direction field yarns have a cross-sectional shape different than a cross-sectional shape of the cross machine direction rib yarns.

12. The woven geotextile fabric of claim 1, wherein:

an end count density of the cross machine direction rib yarns is at least about 1 or more times an end count density of the cross machine direction field yarns; and/or an end count density of machine direction rib yarns is at least about 1 or more times an end count density of the machine direction field yarns.

13. The woven geotextile fabric of claim 1, wherein:

the machine direction rib yarns comprise polyethylene terephthalate filament yarns having a denier of at least about 18,000, a generally round cross-sectional shape, a tenacity of at least about 6.5 grams per denier, and an end count of at least 24 per inch;

the cross machine direction rib yarns comprise polyethylene terephthalate filament yarns having a denier of at least about 18,000, a generally round cross-sectional shape, a tenacity of at least about 6.5 grams per denier, and an end count of at least 18 per inch;

the machine direction field yarns comprise polypropylene slit tape yarns having a generally rectangular cross-sectional shape and a denier, a tenacity, and an end count per inch that are less than the machine direction rib yarns; and the cross machine direction field yarns comprise polypropylene slit tape yarns having a generally rectangular cross-sectional shape and a denier, a tenacity, and an end count per inch that are less than the cross machine direction rib yarns.

14. The woven geotextile fabric of claim 1, wherein the plurality of yarns is integrally woven together to thereby provide a single woven component that integrally includes the woven geotextile fabric with the integrated geotextile grid, without having to separately manufacture first and second distinct components that respectively include the woven geotextile fabric and the integrated geotextile grid and without having to physically attach, laminate, glue, or heat bond the integrated geotextile grid separately to the woven geotextile fabric.

15. The woven geotextile fabric of claim 1, wherein the plurality of yarns is integrally woven together to thereby provide a single woven component that integrally includes the woven geotextile fabric with the integrated geotextile grid, without having to separately manufacture the woven geotextile fabric and the integrated geotextile grid.

16. A woven geotextile fabric comprising:

machine direction ribs and cross machine direction ribs cooperatively defining an integrated ribbed geogrid integrally woven within the woven geotextile fabric without having to manufacture the integrated ribbed geogrid separately from the woven geotextile fabric and/or without having to physically attach the integrated ribbed geogrid separately to the woven geotextile fabric; and woven geotextile fabric areas in a field of the integrated ribbed geogrid generally between the machine direction ribs and the cross machine direction ribs.

17. The woven geotextile fabric of claim 16, wherein the machine direction ribs and cross machine direction ribs cooperatively define the integrated ribbed geogrid integrally woven within the woven geotextile fabric without a separate physical non-woven attachment between the integrated ribbed geogrid and the woven geotextile fabric.

18. The woven geotextile fabric of claim 16, wherein the machine direction ribs and cross machine direction ribs cooperatively define the integrated ribbed geogrid integrally woven within the woven geotextile fabric without a lamination, glue, or heat bond between the integrated ribbed geogrid and the woven geotextile fabric.

19. The woven geotextile fabric of claim 16, wherein the machine direction ribs and cross machine direction ribs cooperatively define the integrated ribbed geogrid integrally woven within the woven geotextile fabric without laminating, gluing, heat bonding, or mechanical fastening the integrated ribbed geogrid and the woven geotextile fabric.

20. The woven geotextile fabric of claim 16, wherein:

yarn type and yarn density of the woven geotextile fabric change along the machine direction; and yarn type and yarn density of the woven geotextile fabric change along the cross machine direction.

21. The woven geotextile fabric of claim 16, wherein the woven geotextile fabric comprises a plurality of yarns integrally woven together including:

machine direction rib yarns defining the machine direction ribs;

cross machine direction rib yarns defining the cross machine direction ribs;

machine direction field yarns and cross machine direction field yarns cooperatively defining the woven geotextile fabric areas generally between the machine direction ribs and the cross machine direction ribs;

the machine direction ribs and the cross machine direction ribs cooperatively define the integrated ribbed geogrid as an integral part of the woven geotextile fabric; and the machine direction ribs and the cross machine direction ribs are thicker and have higher tensile strength than the machine direction field yarns and the cross machine direction field yarns.

22. The woven geotextile fabric of claim 21, wherein:

the machine direction rib yarns and the cross machine direction rib yarns comprise yarns having a tenacity of at least about 4.5 grams per denier, and/or the machine direction rib yarns and the cross machine direction rib yarns comprise polyethylene terephthalate filament yarns;

an end count density of the cross machine direction rib yarns is at least about 1 or more times an end count density of the cross machine direction field yarns;

an end count density of machine direction rib yarns is at least about 1 or more times an end count density of the machine direction field yarns;

the machine direction field yarns have a cross-sectional shape different than a cross-sectional shape of the machine direction rib yarns; and the cross machine direction field yarns have a cross-sectional shape different than a cross-sectional shape of the cross machine direction rib yarns.

23. The woven geotextile fabric of claim 21, wherein:

the machine direction rib yarns comprise polyethylene terephthalate filament yarns having a denier of at least about 18,000, a generally round cross-sectional shape, a tenacity of at least about 6.5 grams per denier, and an end count of at least 24 per inch;

the cross machine direction rib yarns comprise polyethylene terephthalate filament yarns having a denier of at least about 18,000, a generally round cross-sectional shape, a tenacity of at least about 6.5 grams per denier, and an end count of at least 18 per inch;

the machine direction field yarns comprise polypropylene slit tape yarns having a generally rectangular cross-sectional shape and a denier, a tenacity, and an end count per inch that are less than the machine direction rib yarns; and the cross machine direction field yarns comprise polypropylene slit tape yarns having a generally rectangular cross-sectional shape and a denier, a tenacity, and an end count per inch that are less than the cross machine direction rib yarns.

24. The woven geotextile fabric of claim 16, wherein the integrated ribbed geogrid cooperatively defined by the machine direction ribs and the cross machine direction ribs is thicker than, has a higher tensile strength than and has a higher pullout resistance in soil than the woven geotextile fabric areas in the field of the integrated ribbed geogrid.

25. The woven geotextile fabric of claim 16, wherein the woven geotextile fabric comprises a plurality of yarns integrally woven together to thereby provide a single woven component that integrally includes the woven geotextile fabric with the integrated ribbed geogrid, without having to separately manufacture first and second distinct components that respectively include the woven geotextile fabric and the integrated ribbed geogrid and without having to physically attach, laminate, glue, or heat bond the integrated ribbed geogrid separately to the woven geotextile fabric.

26. The woven geotextile fabric of claim 16, wherein the woven geotextile fabric comprises a plurality of yarns integrally woven together to thereby provide a single woven component that integrally includes the woven geotextile fabric with the integrated ribbed geogrid, without having to separately manufacture the woven geotextile fabric and the integrated ribbed geogrid.

27. A method comprising weaving a plurality of yarns together in a single operation on a weaving machine to thereby provide a woven geotextile fabric having an integrated geotextile grid integrally woven within the woven geotextile fabric during the single operation on the weaving machine without having to manufacture the integrated geotextile grid separately from the woven geotextile fabric and/or without having to physically attach the integrated geotextile grid separately to the woven geotextile fabric.

28. The method of claim 27, wherein the integrated geotextile grid increases tensile strength of the woven geotextile fabric without having to manufacture the integrated geotextile grid separately from the woven geotextile fabric and without having to physically attach the integrated geotextile grid separately to the woven geotextile fabric.

29. The method of claim 27, wherein the method includes weaving the plurality of yarns together in the single operation on the weaving machine to thereby provide the woven geotextile fabric having the integrated geotextile grid integrally woven within the woven geotextile fabric as a single woven component without having to physically attach the integrated geotextile grid separately to the woven geotextile fabric.

30. The method of claim 27, wherein:

the plurality of yarns comprise machine direction field yarns, cross machine direction field yarns, machine direction rib yarns, and cross machine direction rib yarns; and weaving the plurality of yarns together in a single operation on a weaving machine includes weaving the machine direction rib yarns, the cross machine direction rib yarns, the machine direction field yarns, and the cross machine direction field yarns together in the single operation on the weaving machine such that:

the machine direction rib yarns and the cross machine direction rib yarns cooperatively define the integrated geotextile grid integrally woven within the woven geotextile fabric; and the machine direction field yarns and the cross machine direction field yarns cooperatively define fabric areas in a field of the integrated geotextile grid generally between the machine direction rib yarns and the cross machine direction rib yarns.

31. The method of claim 30, wherein yarn type and yarn density of the woven geotextile fabric change along both the machine direction and the cross machine direction.

32. The method of claim 30, wherein:

the machine direction rib yarns and the cross machine direction rib yarns are thicker and have higher tensile strength than the machine direction field yarns and the cross machine direction field yarns; and the integrated geotextile grid cooperatively defined by the machine direction rib yarns and the cross machine direction rib yarns is thicker than, has a higher tensile strength than, and has a higher pullout resistance in soil than the fabric areas cooperatively defined by the machine direction field yarns and the cross machine direction field yarns.

33. The method of claim 27, wherein:

the plurality of yarns comprise machine direction field yarns, cross machine direction field yarns, machine direction rib yarns, and cross machine direction rib yarns; and weaving the plurality of yarns together in a single operation on a weaving machine comprises weaving the machine direction rib yarns, the cross machine direction rib yarns, the machine direction field yarns, and the cross machine direction field yarns together in the single operation on the weaving, which includes:

inserting at least two cross machine direction rib yarns about every inch in the cross machine direction at a density greater than a density of the ends of the cross machine direction field yarns; and inserting at least two machine direction rib yarns about every inch in the machine direction at a density greater than a density of the ends of the machine direction field yarns.

34. The method of claim 27, wherein the method includes weaving the plurality of yarns in a single operation on a weaving machine such that the woven geotextile fabric having the integrated geotextile grid is provided as a single woven component that integrally includes the woven geotextile fabric and the integrated geotextile grid woven together, without having to physically attach, laminate, glue, or heat bond the integrated geotextile grid separately to the woven geotextile fabric.

35. The method of claim 27, wherein the method includes weaving the plurality of yarns in a single operation on a weaving machine such that the woven geotextile fabric having the integrated geotextile grid is provided as a single woven component that integrally includes the woven geotextile fabric and the integrated geotextile grid woven together, without having to separately manufacture first and second distinct components that respectively include the woven geotextile fabric and the integrated geotextile grid.

36. The method of claim 27, wherein the method further comprises producing and preparing the plurality of yarns before weaving the plurality of yarns in the single operation on the weaving machine.

37. The method of claim 27, wherein:

the plurality of yarns comprise machine direction field yarns, cross machine direction field yarns, machine direction rib yarns, and cross machine direction rib yarns; and weaving the plurality of yarns together in a single operation on a weaving machine comprises weaving the machine direction rib yarns, the cross machine direction rib yarns, the machine direction field yarns, and the cross machine direction field yarns together in the single operation on the weaving, which includes:

inserting the machine direction rib yarns to create machine direction ribs such that the machine direction ribs are integrally woven into the woven geotextile fabric whereby the machine direction rib yarns are an integrated part of the overall woven geotextile fabric;

weaving the machine direction rib yarns at intermittent junctions with very little crimp;

placing the cross machine direction rib yarns into the woven geotextile fabric by modifying an end count density of the weaving machine during insertion of the cross machine direction rib yarns; and changing a density of the cross machine direction yarns while introducing a plurality of different cross machine direction yarns.

* * * * *